US009382751B2

(12) United States Patent
Hemping et al.

(10) Patent No.: US 9,382,751 B2
(45) Date of Patent: Jul. 5, 2016

(54) DOOR SYSTEMS AND DOOR HARDWARE COMPONENTS

(71) Applicant: Andersen Corporation, Bayport, MN (US)

(72) Inventors: Kelly Hemping, Pleasant Hill, IA (US); Jesse Baldwin, Bondurant, IA (US); Korey Gearhart, Norwalk, IA (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 14/512,794

(22) Filed: Oct. 13, 2014

(65) Prior Publication Data

US 2015/0027061 A1 Jan. 29, 2015

Related U.S. Application Data

(63) Continuation of application No. 13/218,884, filed on Aug. 26, 2011, now Pat. No. 8,857,105.

(60) Provisional application No. 61/377,231, filed on Aug. 26, 2010.

(51) Int. Cl.
*E06B 3/72* (2006.01)
*E05B 1/00* (2006.01)
(Continued)

(52) U.S. Cl.
CPC . *E06B 3/72* (2013.01); *E05B 1/003* (2013.01); *E05B 15/02* (2013.01); *E05C 21/00* (2013.01); *E05D 15/00* (2013.01); *E06B 3/36* (2013.01); *E06B 3/70* (2013.01); *E06B 7/18* (2013.01); *E06B 7/2312* (2013.01); *E06B 7/2316* (2013.01); *Y10T 16/61* (2015.01); *Y10T 70/5155* (2015.04); *Y10T 292/57* (2015.04); *Y10T 292/85* (2015.04)

(58) Field of Classification Search
CPC ..... E06B 3/72; E06B 3/36; E06B 3/70; E06B 7/2312; E06B 7/2316; E06B 7/18; E05D 15/00
See application file for complete search history.

(56) References Cited

U.S. PATENT DOCUMENTS 2,835,525 A * 5/1958 Vahtra ..... 292/169
2,911,095 A 11/1959 Hutch
(Continued)

FOREIGN PATENT DOCUMENTS

GB 2 272 478 A 5/1994
GB 2272478 A * 5/1994 ..... E05B 3/06

OTHER PUBLICATIONS

Krieger Specialty Products. "Typical Problems with Door and Frame Installation" Fact Sheet. Retrieved from the Internet at http://kriegerspecialtyproducts.com/downloads/pibs/PIB_No_102.pdf 1 page.
(Continued)

*Primary Examiner* — Katherine Mitchell
*Assistant Examiner* — Marcus Menezes
(74) *Attorney, Agent, or Firm* — Mueting, Raasch & Gebhardt, P.A.

(57) ABSTRACT

Methods of installing door systems in an opening. The methods involve racking the door system using a bottom spacer located between a bottom of a door panel and the sill such that the door system is not square with respect to the opening when the bottom ends of latch side and hinge side vertical jambs of the door system are resting on the sill of the opening.

34 Claims, 15 Drawing Sheets

(51) Int. Cl.

| | |
|---|---|
| ***E05B 15/02*** | (2006.01) |
| ***E06B 7/18*** | (2006.01) |
| ***E06B 7/23*** | (2006.01) |
| ***E05C 21/00*** | (2006.01) |
| ***E05D 15/00*** | (2006.01) |
| ***E06B 3/36*** | (2006.01) |
| ***E06B 3/70*** | (2006.01) |

(56) References Cited

U.S. PATENT DOCUMENTS

| | | | | |
|---|---|---|---|---|
| 2,917,790 | A * | 12/1959 | Espenschied | 206/325 |
| 3,103,714 | A * | 9/1963 | Wilks | 49/401 |
| 3,205,982 | A | 9/1965 | Chimienti | |
| 3,216,066 | A | 11/1965 | Hadacek | |
| 3,301,820 | A | 1/1967 | Haendiges | |
| 3,393,471 | A * | 7/1968 | Skowlund et al. | 49/475.1 |
| 3,430,385 | A | 3/1969 | Biro | |
| 3,618,261 | A | 11/1971 | Torbett | |
| 3,631,644 | A | 1/1972 | Mazza et al. | |
| 3,871,283 | A * | 3/1975 | John | 109/56 |
| 3,969,866 | A | 7/1976 | Kyne | |
| 4,001,972 | A | 1/1977 | Hurwitz | |
| 4,731,952 | A | 3/1988 | Mascotte | |
| 4,736,565 | A | 4/1988 | Bisson | |
| 5,056,263 | A | 10/1991 | Bies | |
| 5,056,835 | A | 10/1991 | Johnson | |
| 5,152,487 | A | 10/1992 | Defatte et al. | |
| 5,216,839 | A | 6/1993 | Woodruff | |
| 5,337,526 | A | 8/1994 | Hartman | |
| 5,365,697 | A * | 11/1994 | Vanderpan | 49/380 |
| 5,829,098 | A * | 11/1998 | Alonso | 16/71 |
| 6,397,431 | B1 | 6/2002 | Alonso | |
| 6,405,506 | B2 | 6/2002 | Ruff | |
| 6,622,432 | B2 * | 9/2003 | Zacher et al. | 49/501 |
| 6,634,059 | B2 | 10/2003 | Seiferd | |
| 6,640,387 | B2 | 11/2003 | Alonso | |
| 6,676,178 | B2 | 1/2004 | Budhrani | |
| 6,883,203 | B2 | 4/2005 | Libes | |
| 7,007,439 | B1 | 3/2006 | Larson et al. | |
| 7,117,639 | B2 | 10/2006 | Abdella et al. | |
| 7,213,299 | B2 | 5/2007 | Grande | |
| 7,347,462 | B2 | 3/2008 | Ellis et al. | |
| 7,497,344 | B2 | 3/2009 | Chen | |
| D595,866 | S | 7/2009 | Kibbel et al. | |
| 7,581,352 | B2 | 9/2009 | Klingbyle | |
| 7,588,272 | B2 * | 9/2009 | Gephart | 292/336.3 |
| D605,496 | S | 12/2009 | Scheuermann et al. | |
| 7,661,226 | B2 | 2/2010 | Kibbel et al. | |
| 7,698,796 | B1 | 4/2010 | Dowling et al. | |
| 8,146,295 | B2 | 4/2012 | Kibbel et al. | |
| 8,857,105 | B2 | 10/2014 | Hemping et al. | |
| 2006/0150524 | A1 * | 7/2006 | Kibbel et al. | 49/501 |
| 2006/0260216 | A1 * | 11/2006 | Bonshor | 52/97 |
| 2007/0221597 | A1 | 9/2007 | Chen | |
| 2009/0146439 | A1 * | 6/2009 | Watts et al. | 292/350 |
| 2012/0047809 | A1 | 3/2012 | Hemping et al. | |
| 2013/0047514 | A1 | 2/2013 | Kaestle et al. | |

OTHER PUBLICATIONS

Mizrachi. "How to repair my front door". Mar. 22, 2012. Retrieved from the Internet at http://ths.gardenweb.com/discussions/2596368/how-to-repair-my-front-door 2 pages.

Home Improvement—General/New Pella French Door Installation. Advertisement. Retrieved from the internet on Dec. 11, 2015 at http://en.allexperts.com/q/Home-Improvement-General-688/2008/6/New-Pella-French-Door.htm_. 2 pages.

* cited by examiner

DOOR SYSTEMS AND DOOR HARDWARE COMPONENTS

RELATED APPLICATION

The present application is a continuation of U.S. patent application Ser. No. 13/218,884, which claims the benefit under 35 U.S.C. § 119(e) of U.S. Provisional Patent Application 61/377,231 filed on 26 Aug. 2010, each of which is hereby incorporated by reference in their entirety.

TECHNICAL FIELD

This disclosure relates generally to doors and more specifically to door systems, door hardware components, and to the installation thereof.

BACKGROUND

Traditionally, installation of doors, such as, e.g., storm doors, has not been a simple matter. For example, some doors can be non-handed, meaning that they can be installed with their hinges either on the right or on the left as desired, depending on the installation and user preference for which way the door opens. Positioning and attaching the hinges on the desired side of some door frames (e.g., storm doors) requires significant time and skill and can result in an improperly positioned door panel if not done precisely.

Installation of a handle assembly, closer assembly, and/or strike plate may be problematic, whether they are being installed with a new door or being installed to replace existing hardware on a previously-installed door.

SUMMARY

The door systems and door hardware components described herein include one or more features that may potentially make installation of an entire door system and/or the door hardware components easier to install than traditional doors, traditional doors, and/or door hardware components.

As used herein. The term "door system" is used to describe an assembly that includes a door panel (such as, e.g., a storm door panel) and a pair of jamb members making up a door frame for the door panel and an optional header that is configured to extend between the jambs above the door panel. In some embodiments, the door panel may be hingedly attached to the one of the jambs, and in such a door system, the door system may be described as a "pre-hung door system". The door systems described herein may, in some embodiments, include one or more of the various door hardware components that are described herein, such as, e.g., a bottom spacer, drip cap mounting flanges, a door latch assembly, a closer bracket assembly, etc.

Although the various illustrative embodiments are described in the context of storm doors, it should be understood that the features may be implemented in any suitable door system (e.g., entry doors, etc.)

In some embodiments of tie door systems described herein, the jamb on the latch side of the door panel may be shaped to define an elongated channel along at least a portion of its length, wherein the channel is configured to retain a latch bolt of a latch assembly on the door panel. A strike surface may also extend along the channel for restraining the latch bolt within the channel anywhere along its length.

Among the differences from conventional installation, installation of the door systems described herein may be referenced to the sill of an opening during assembly rather than to the header of the opening. In some embodiments, a bottom spacer may be used to provide automatic adjustment of the sweep relative to the sill of the opening. In some embodiments, the bottom spacer may also apply a corrective rack to the assembly to counter the natural sag of a door panel due, for example, to loose hinges.

In some embodiments of the door systems described herein, a drip cap assembly that can accommodate different width gaps at the top of the door may be used.

The door latch assemblies described herein may be used on both newly installed door systems as well as existing doors. The door latch assemblies preferably include two (e.g., interior and exterior) escutcheon plates. One or both of the escutcheon plates may include a keyway configured to receive the keyed end of a door handle such that the handle can be inserted into the keyway in one or more insertion orientations, but cannot be detached from the escutcheon plate when the door handle is not in the one or more insertion orientations. In some embodiments, a door handle rotatably attached to an escutcheon plate by a keyed end located in a keyway is not, when moved through the range of positions needed to operate the door latch assembly properly, in any of the insertion orientations such that it could be inadvertently detached from the escutcheon plate. Retention of the door handle using a keyed end and keyway may provide the ability to assemble and retain the keyed door handle on the escutcheon plate without requiring the use of tools, thus potentially simplifying installation of the door latch assembly.

The closer bracket assemblies described herein may be used with both the door systems described herein, as well as with existing doors. The closer bracket assemblies described herein include a base that is attached to the jamb of a door opening by, e.g., screws. If screws are to be used to fasten the base to a jamb, it may be preferred that the base be designed such that no two screws are aligned vertically such that they would be positioned along the same or similar grain line if the jamb is made of wood with vertically-oriented grain lines. A closer bracket is designed to be attached to the base, with the closer cylinder being attached to the closer bracket. In some embodiments, proper positioning of the closer bracket relative to the door may be obtained by butting the base against the jamb of one of the door systems described herein. In other embodiments in which the closer bracket assembly is to be used with an existing door, the base of the closer bracket assembly may be configured to abut the door panel itself to provide proper positioning of the closer bracket attached to the base. In some embodiments, the closer bracket may be attached to the base using a combination of interlocking tabs and slots in the base and closer bracket and a threaded fastener. In other embodiments, the closer bracket may be attached to the base without the need for threaded or other fasteners, i.e., the closer bracket may be attached only by the mechanically interlocking structures of the base and the closer bracket.

The words "preferred" and "preferably" refer to embodiments that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, "a," "an," "the," "at least one," and "one or more" are used interchangeably, Thus, for example, a mounting flange may be used to refer to one, two, three or more mounting flanges.

The term "and/or" means one or all of the listed elements or a combination of any two or more of the listed elements.

The above summary is not intended to describe each embodiment or every implementation of the door systems, door hardware components, and methods described herein. Rather, a more complete understanding of the door systems, door hardware components, and methods described herein will become apparent and appreciated by reference to the following Description of Illustrative Embodiments and claims in view of the accompanying figures.

DESCRIPTION OF ILLUSTRATIVE EMBODIMENTS

In the following description of illustrative embodiments, reference is made to the accompanying figures which form a part hereof, and in which are shown, by way of illustration, specific embodiments in which the door systems, door hardware components, and methods may be practiced. It is to be understood that other embodiments may be utilized and structural changes may be made without departing from the scope of the present invention.

Figure 1A:
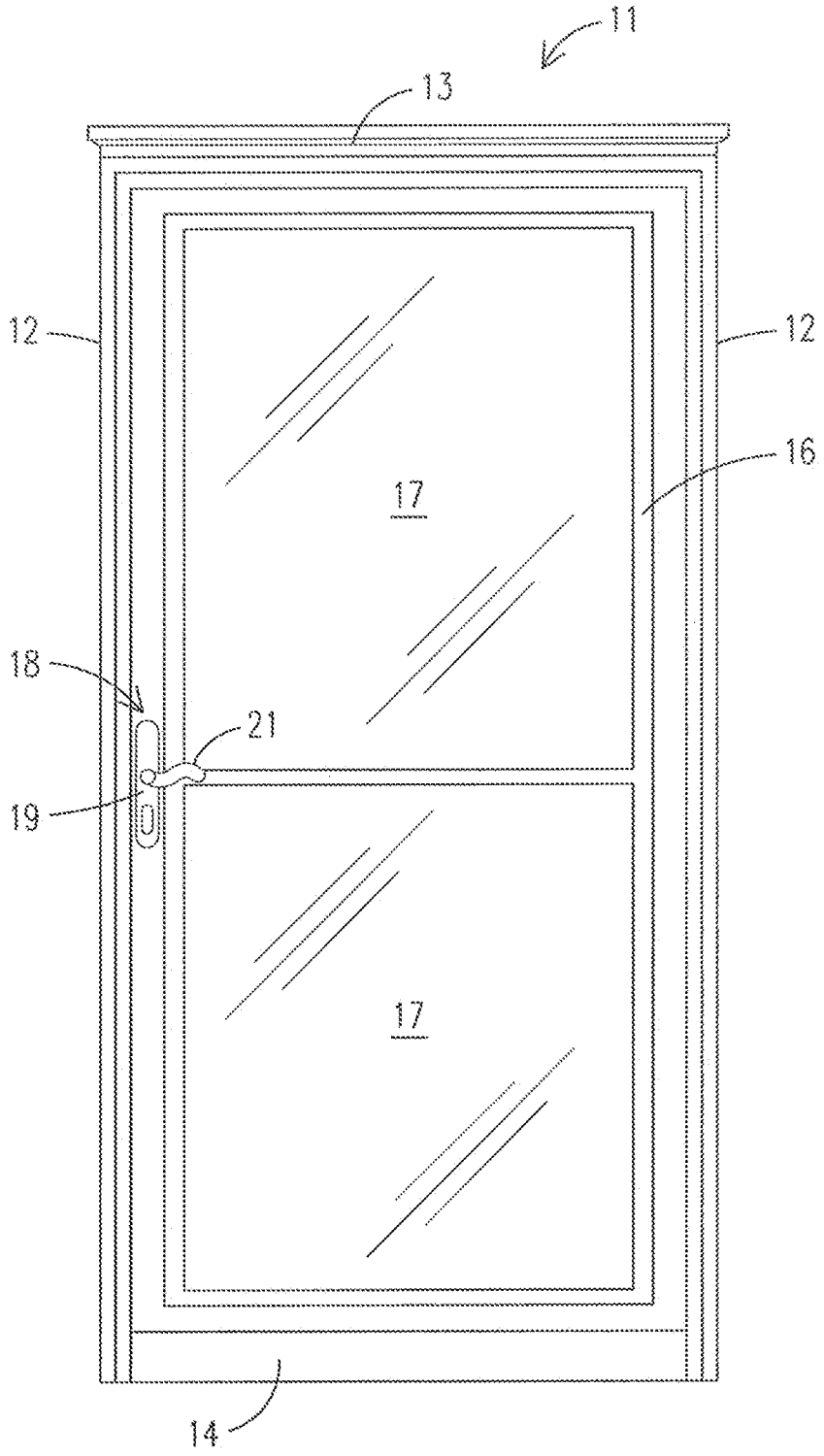
FIG. 1a (PRIOR ART)
FIG. 1*a* is a front plan view of an exemplary traditional storm door.

FIG. 1*a* is a plan view of a conventional storm door system 11. The door system 11 depicted in FIGS. 1*a* & 1*b* has a frame comprised of vertical jamb members 12, and a header 13, which incorporates a drip cap. A storm door panel 16 is mounted in the frame and is hinged in this figure to the right-hand vertical jamb member 12. An adjustable sweep 14 may be mounted to the bottom of the door panel and, in this illustration, glass panels 17 are mounted in the door panel. A latch assembly 18 includes an escutcheon plate 19 and a handle 21 for disengaging a latch bolt (not visible) to allow the storm door to be opened. A similar escutcheon plate and handle may be disposed on the other side of the storm door panel.

Figure 1B:
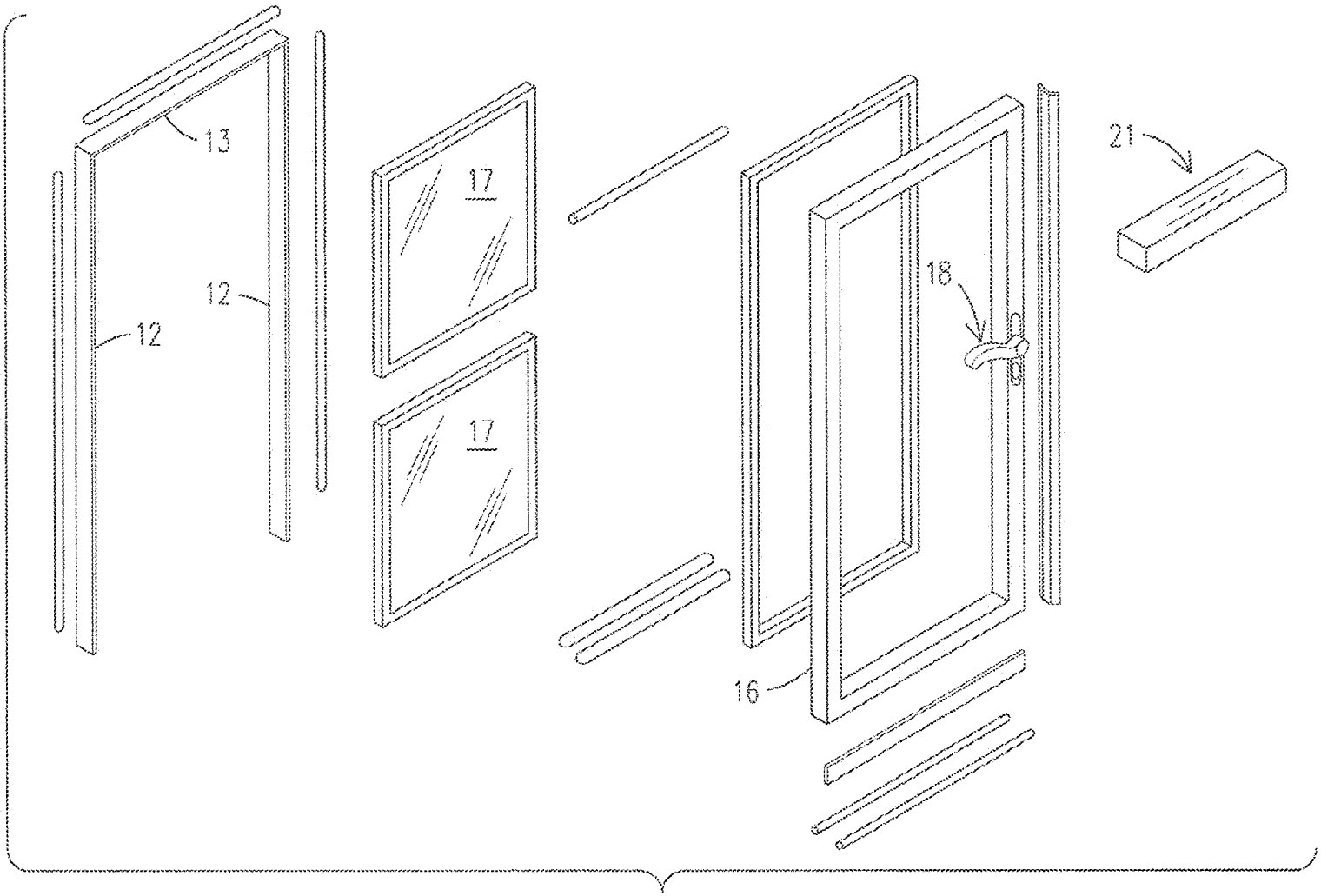
FIG. 1b (PRIOR ART)
FIG. 1*b* is an exploded perspective of the exemplary storm door of FIG. 1*a* showing the components thereof.

FIG. 1*b* is an exploded perspective of the storm door assembly shown in FIG. 1*a* and illustrates relative placement of the vertical jamb members 12 and drip cap 13 of the frame, the door panel 16, glass panels 17 and latch assembly 18. A closer assembly 21 is part of the storm door system for limiting the degree to which the door can be opened and for providing a controlled and slow closing motion to the storm door panel. FIGS. 1*a* and 1*b* are presented to illustrate and introduce various components and elements of the storm door system hereof, and these components and elements win be referenced in the discussions that follow.

Figure 2:
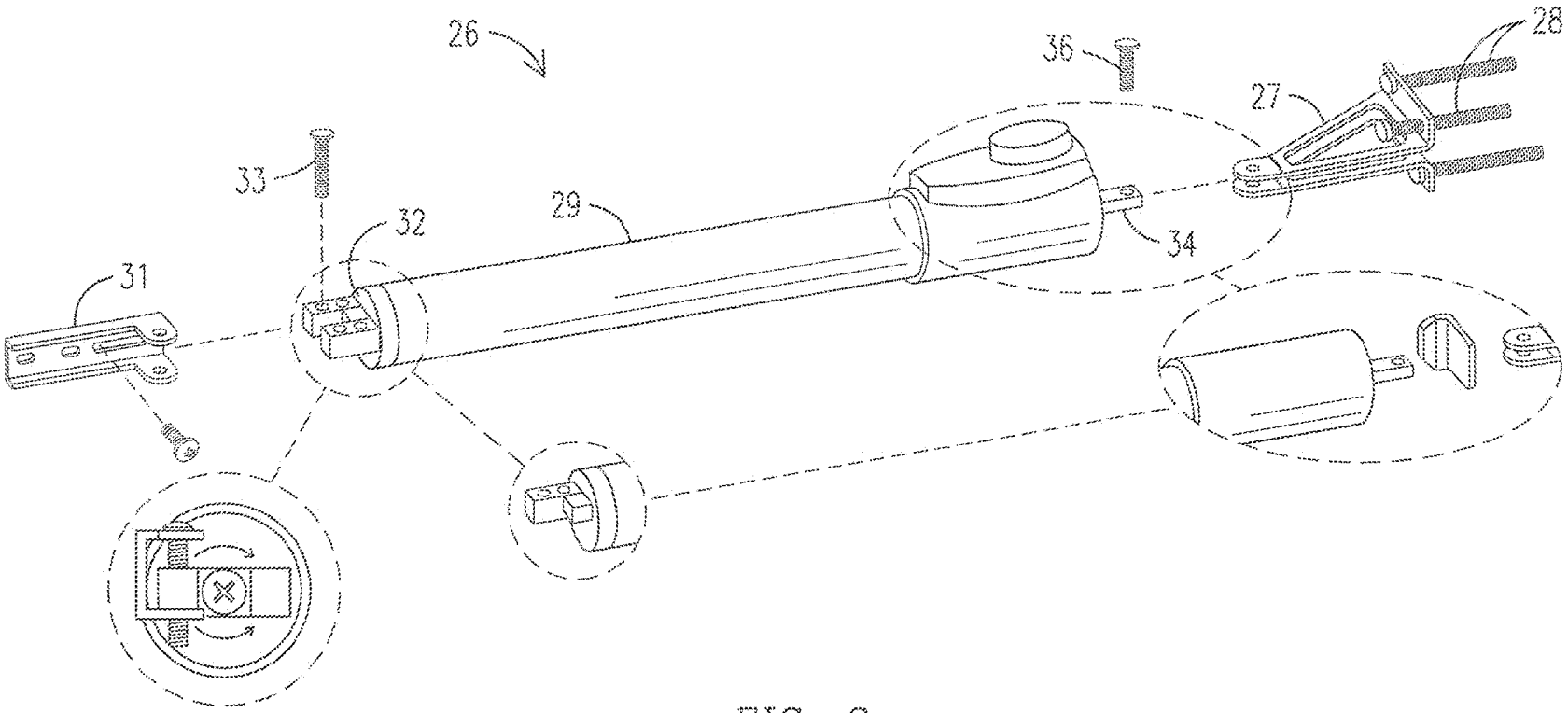
FIG. 2 PRIOR ART
FIG. 2 illustrates a prior art closer assembly.

FIG. 2 illustrates e traditional prior ad closer assembly for doors such as, e.g., storm doors. The closer assembly 26 includes a pneumatic spring cylinder 29 having an and 32. An extendable shaft 34 projects from the other end of the cylinder 29 and, when pulled out, retracts back in a slow and controlled manner. An elongated triangular closer bracket 27 attaches to the jamb of an opening on the inside of the storm door with long wood screws 28. It can be seen from this drawing that the screws are vertically aligned in pairs, which can cause splitting as discussed above. Further, the length of the bracket makes it difficult to access the screw heads for during the screws into the wood of the jamb. A door bracket 31 attaches to the storm door panel and the end 32 of the cylinder 29 is attached to the door bracket by a pin 33. The end of the shaft 34 at the other end of the cylinder attaches with a pin 36 to the end of the closer bracket 27. When the storm door is opened, the shaft 34 is pulled out of the cylinder and when the door is released, the shaft retracts back into the cylinder to close the door.

Figure 3:
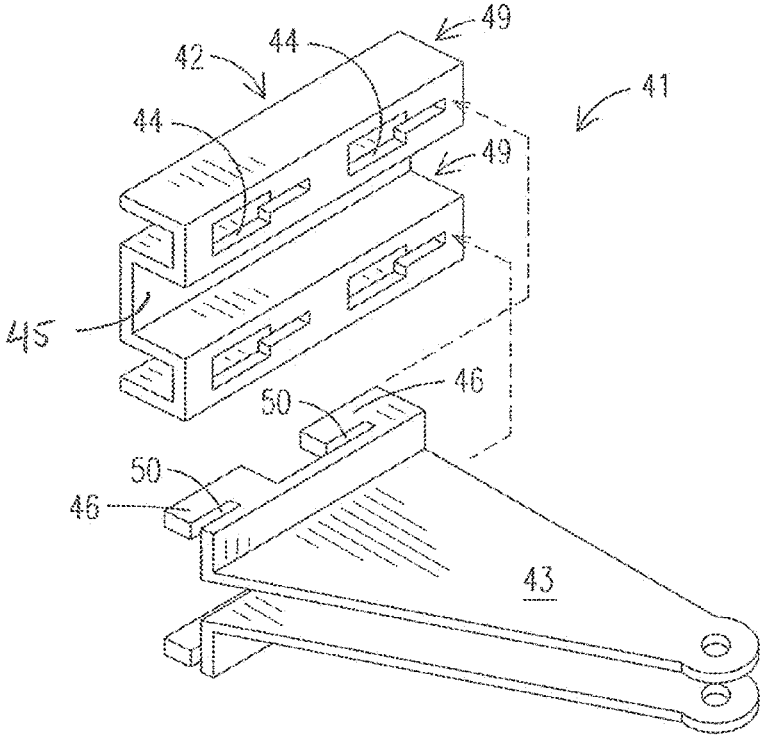
FIG. 3 is a perspective view of one embodiment of a two-piece closer bracket assembly as described herein.
Figure 4:
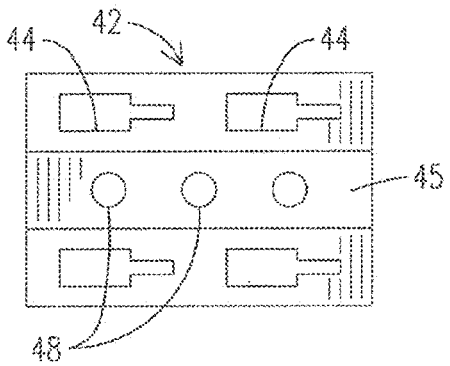
FIG. 4 is a plan view of the base of the closer bracket shown in FIG. 3.
Figure 5:
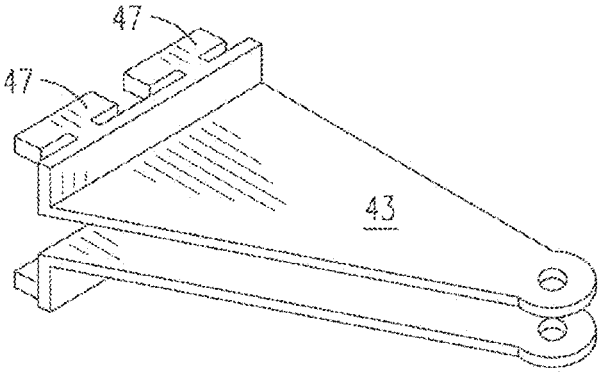
FIG. 5 is a perspective view of an end portion of the bracket of FIG. 3 showing an alternative tongue arrangement for connecting the bracket to the base.

FIGS. 3-5 illustrate one illustrative embodiment of a closer bracket assembly that may be one component of some embodiments of the door systems described herein or that may, in some instances, be used with an existing door in place of a conventional closer bracket as seen, e.g., in FIG. 2. The closer bracket assembly 41 comprises a base 42 configured for attachment to the jamb along one side of a door opening and a closer bracket 43 that attaches to the base 42. The base 42 includes spaced apart legs 49 spanned by a mounting plate 45. Each of the legs 49 of the base is formed with a pair of slots that, in this embodiment are narrow on one end and wider on the opposite end. The base 42 may be manufactured of any suitable material, e.g., metal (e.g., steel, etc), polymers, etc.

As shown in FIG. 4, the mounting plate 45 is provided with screw holes 48 through which screws may be driven into a door jamb of an opening to attach the base to the jamb. Since the screw holes 48 are horizontally arrayed, in a typical installation In which a door opening jamb is constructed of a vertically oriented board, only one screw is driven into the jamb along any one wood grain line, thus potentially reducing the chances of splitting the wood of the jamb.

In some embodiments of the closer bracket assemblies described herein, the base 42 may be "self-aligning" such that the closer bracket assembly 41 can be properly spaced from the door panel as described herein. In the depleted embodiment, the length of the base 42 and the placement and engagement of the detachable closer bracket 43 with the base 42 ensures proper and precise horizontal positioning of the closer bracket assembly relative to the door because the base 42 is sized such that by abutting the base 42 against the jamb to which the door panel is hingedly attached when the base 42 is attached to the opening properly spaces the base 42 and the closer bracket 43 relative to the door panel when the closer bracket 43 is attached to the base 42.

If the closer bracket assembly is installed on an existing door, the self-aligning base 42 may be configured to about the door panel itself to provide proper positioning of the closer bracket assembly relative to the door panel for proper operation for a closer attached to the closer bracket assembly.

The closer bracket 43 attached to the base 42 has, in the depicted embodiment, an elongated body with a free end having a hole for receiving the pin attaching a closer cylinder to the bracket The closer bracket 43 is configured 16 be removably attached to the base 42. As used to describe attachment of the closer bracket 43 to the base 42, "removably attached" means that the closer bracket 43 can be removed from the base without requiring destruction, deformation (e.g., cutting, bending, etc.) or other permanent changes to the base such that the closer bracket 43 can be re-attached to the base 42 from which it was removed.

In some embodiments of the closer bracket assemblies described herein, the closer bracket 43 mechanically interlocks with the base 42. For example, in the depicted embodiment the closer bracket 43 includes tabs 48 having recesses 50. The tabs 46 are configured to be inserted into the slots 44 of the base 42. The interlocking structure of the tabs 48, recesses 50 and slots 44 can be used to mechanically interlock the closer bracket 43 with the base 42. More specifically, the tabs 46 are inserted into the slots 44 and the bracket 43 is slid to the left as seen in FIG. 1. When slid completely to the left. The tabs 48 are free to drop down into the wider portions of the slots, which locks the bracket 43 in place to the base. However, the bracket 43 is detachable from the base 42 by reversing the above procedure to remove it from the entryway if needed so that it is not an obstruction. Further, it should be understood that the actual movement of the closer bracket 43 relative to the base 42 is changeable, e.g., in some designs, the closer bracket 43 may need to be moved in a direction other than to the right to mechanically interlock the base 42 and the closer bracket 43.

In addition, in those embodiments that use one or more tabs and one or more slots to mechanically interlock the base and the closer bracket, the tabs and the slots may be provided on either part, i.e., the tabs are not required to be found on the closer bracket nor are the slots required to be on the base. Any arrangement of the mechanically interlocking structures be used as long as the structures perform the mechanically interlocking functions required to attach the closer bracket to the base.

FIG. 5 illustrates a possible alternate embodiment of the closer bracket 43 that mechanically interlocks with a base. In that depleted embodiment, the closer bracket 43 includes T-shaped tabs 47 that might, for example, be detachably mounted to a base with slots that are wider in their mid-portions and narrower at their end portions. As discussed above, other configurations of mechanically interlocking connections between the base and the closer bracket of the closer bracket assemblies may also be used and should be considered to fall within the scope of the closer bracket assemblies as described herein.

FIGS. 6*a*-6*e* illustrate one embodiment of a door latch assembly that may be included as a component of some embodiments of the door systems described herein or that may, in some instances, be used with an existing door. In the depicted embodiment, the latch assembly 51 comprises an exterior escutcheon plate 62 and an interior escutcheon plate 53. An exterior handle 54 is rotatably attached to the exterior escutcheon plate 53 and an interior handle 55 is rotatably attached to the interior escutcheon plate 53. A driving rod (not shown) extends between the hub of the exterior handle 54 and the interior handle 55 when the door latch assembly 51 is assembled. In some embodiments, screw bosses 58 and 59 may be provided on at least one of the escutcheon plates to assist with alignment of the escutcheon plates and the insertion of attachment screws.

One or both of the exterior handle 54 and the interior handle 55 may preferably be rotatably attached to the corresponding escutcheon plate using one or more keyways 57 formed in the escutcheon plate and a complementary keyed hub 56 formed on the door handle.

The keyways provided in one or both of the escutcheon plates may be configured to receive the keyed end of a door handle such that the handle can be inserted into the keyway in one or more insertion orientations, but cannot be detached from the escutcheon plate when the door handle is not in the one or more insertion orientations. In some embodiments, a door handle rotatably attached to an escutcheon plate by a keyed end located in a keyway is not, when moved through the range of positions needed to operate, the door latch assembly properly. In any of the insertion orientations such that it could be inadvertently detached from the escutcheon plate. Retention of the door handle using a keyed end and keyway may provide the ability to assemble and retain the keyed door handle on the escutcheon plate without requiring the use of tools, thus potentially simplifying installation of the door latch assembly.

Figure 6A:
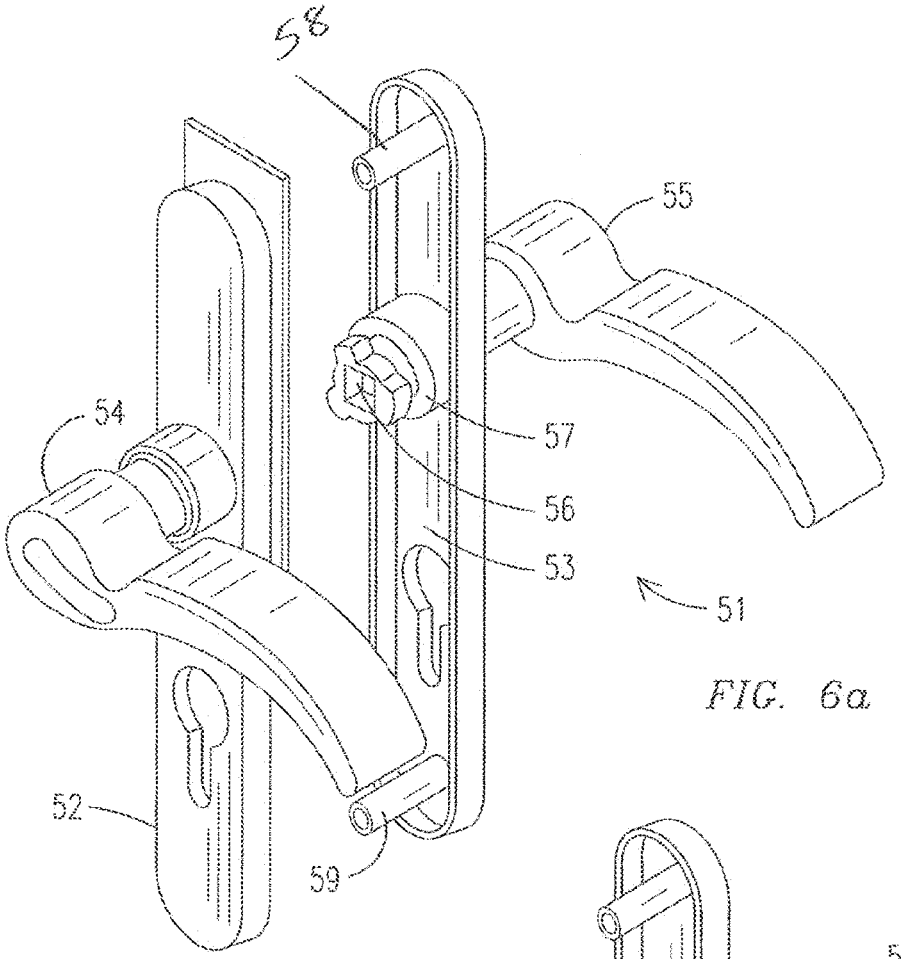
FIGS. 6*a*-6*e* depict one embodiment of a door latching assembly as described herein.
Figure 6B:
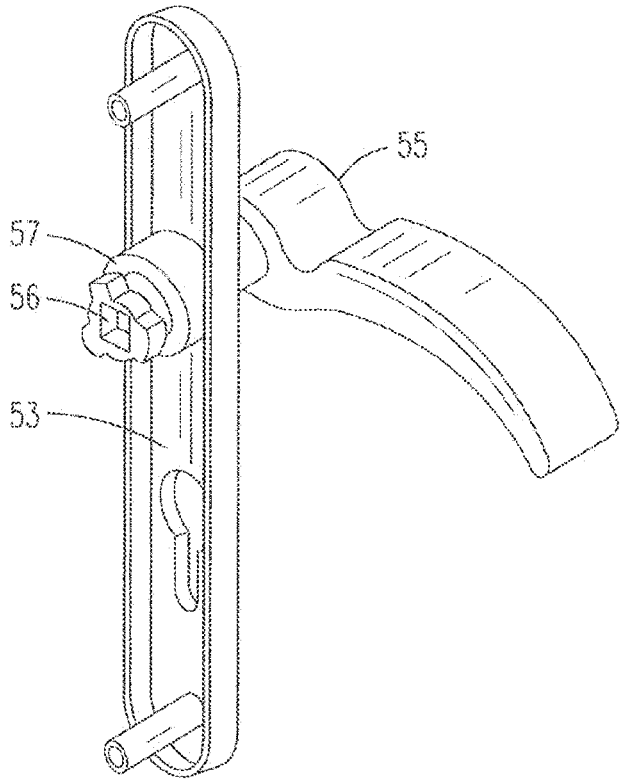

In the depicted embodiment, the keyways and keys are configured such that the handles can be attached to their respective escutcheon plates when the handles are oriented downwardly (e.g., typically towards the floor or ground) and rotated up to their operative position shown in FIG. 6*a*. When rotated out of the insertion orientation (i.e., downwardly in the depicted embodiment), the keys and the keyway interfered with each other so that the door handle is attached to the escutcheon plate in the manner that allows the handle to rotate as needed for operating the door latch assembly, but it remains attached to the escutcheon plate so that it cannot be removed (unless returned to the insertion orientation).

When the two escutcheon plates of the handle assembly are mounted to the door panel of the storm door with the latch mechanism of the assembly between them, a driving rod extends through the latch mechanism in the door panel between the interior and exterior door handles. In some embodiments of the door latch assemblies described herein, the handles may not (during normal operation, i.e., when the latch assembly is operational), rotate completely to the insertion orientation (e.g., the downward position), so that the interior handle 55 remains attached to the escutcheon plate 63 and the exterior handle 54 remains attached to the exterior escutcheon plate 52. Accordingly, in some embodiments, the handles may be attached to their respective escutcheon plates easily, quickly, and without the use of a troublesome set screw or tools.

Figure 6C:
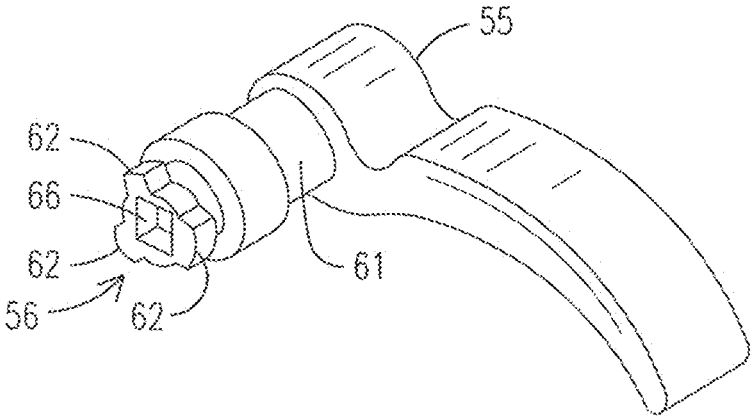
Figure 6D:
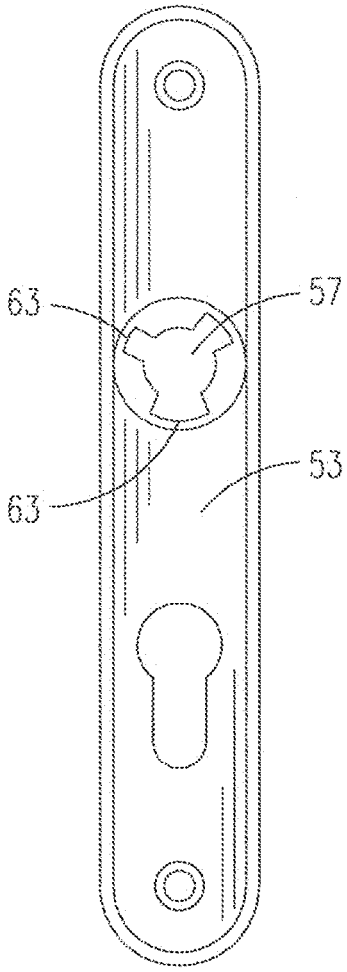
Figure 6E:
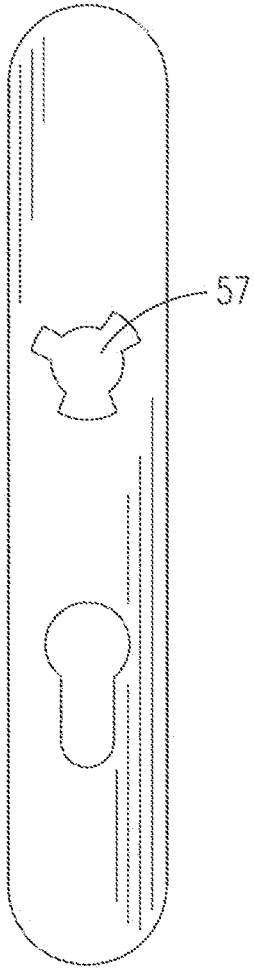

FIGS. 6*c* through 6*e* illustrate one embodiment of the one or more keys 62 on the handle hub 61 and the complementary keyway 57 with lobes 63 corresponding to the keys 62 in the escutcheon plate. In this embodiment, the lobes and corresponding keys may be selected such that the handle hub can only be inserted in the keyway 57 of the escutcheon plate in a single insertion orientation (i.e., the downward orientation as discussed herein). In other embodiments, however, the keys and keyways may be sized and/or shaped such that a different insertion orientation is used to attach the handles to the escutcheon plates (e.g., when the handles are oriented horizontally towards the door edge, upwardly (away from the floor/ground, etc.). In still other embodiments, more than one insertion orientation may be possible if the keys and keyways are designated to accommodate multiple insertion orientations.

In some embodiments of the door systems described herein, the door system may be referenced, when mounted in an opening, to the bottom or sill of the opening rather than to the top or header of the opening. In other words, to install the door system in an entry opening, it is positioned in the opening with the bottoms of its vertical jambs resting on the sill as opposed to being raised up to engage the drip cap with the header as in prior art systems.

In some embodiments of the door systems described herein a resulting gap at the top of the door may preferably be covered and compensated for with an appropriate drip cap mounting flange attached to the drip cap of the storm door assembly as discussed in more detail below with reference to FIGS. 9 and 9*a*. In some embodiments, drip cap mounting flanges of different heights may be provided with some embodiments of the door system to accommodate gaps above the drip cap that have a different height.

Figure 7:
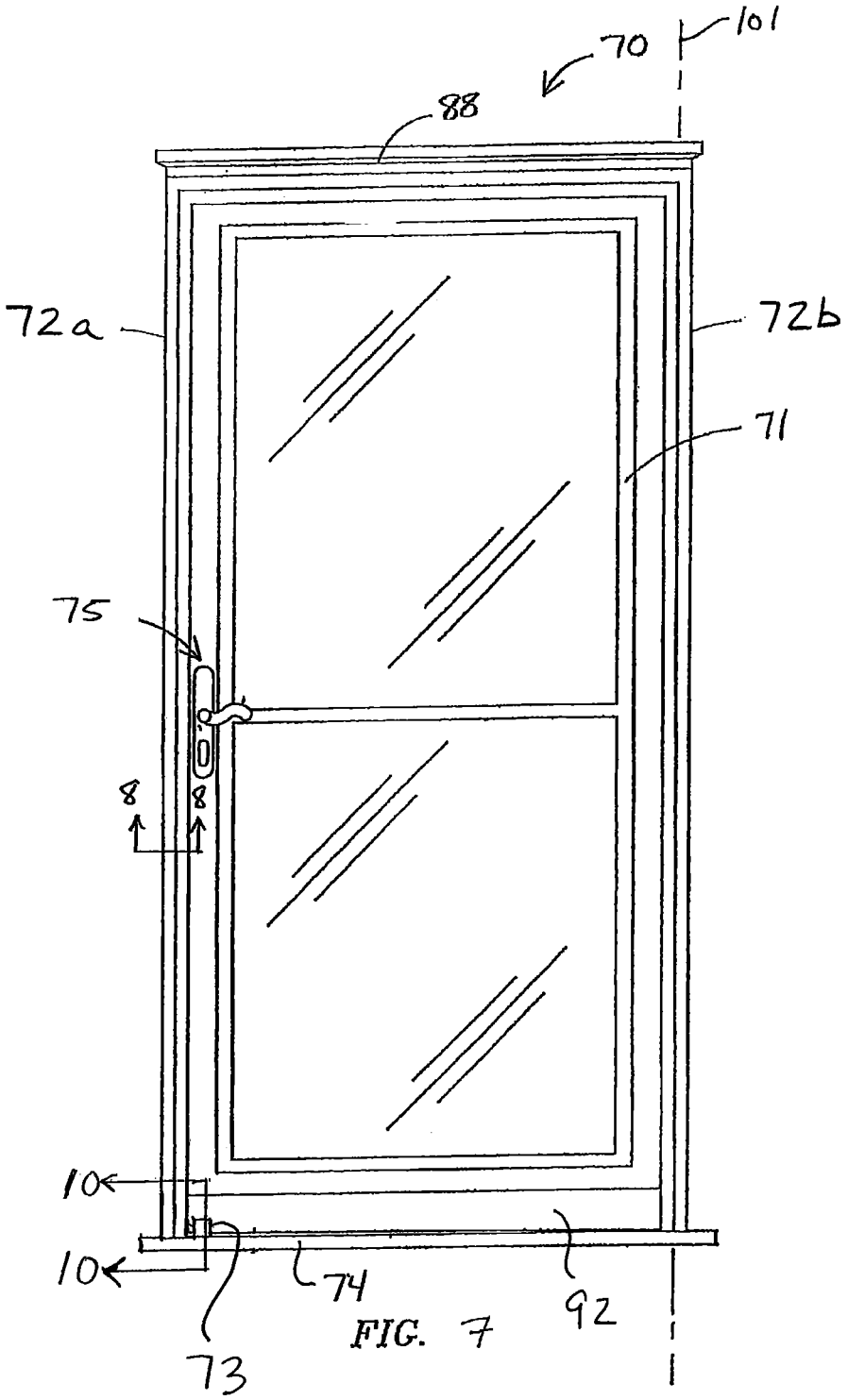
FIG. 7 depicts one embodiment of a bottom spacer as described herein.

Referencing the door system to the sill rather than the header may, in some embodiments (e.g., in pre-hung door systems), provide an opportunity to compensate for any potential sag of the door panel within its frame when installed. FIG. 7 illustrates one embodiment of a door system 70 for accomplishing this. The door system includes a door panel 71 and vertical side jambs including a latch side iamb 72*a* and a hinge side jamb 72*b* (referred to collectively as side jambs 72) with the door panel 71 rotating relative to the opening about an axis 101. A header 88 spans the tops of the jambs 72 above the door panel 71. In the depicted embodiment, a temporary bottom spacer 73 is disposed proximate the bottom of the door panel 71 in an area below the latch side of the door panel 71 (i.e., the side of the door panel carrying the latch assembly 75) during installation. Since the bottoms of the jambs 72 of the door system rest on the sill 74 of an opening when the door system is placed in the opening, the spacer 73 racks the door system slightly upward on the handle side so that it may preferably be slightly out of square. As used herein, the term "racks" (and variations thereof) is used in accordance with its conventional definition, which means, e.g., movement and/or retention of the door panel relative to at least a portion of the frame such that the door panel and the portion or portions of the frame are not perpendicular and/or parallel to each other.

After the jambs 72 of the door system are attached with screws (or other fasteners) to the brick mould or other trim around the opening, the bottom spacer 73 can be removed. In some embodiments, removal of the spacer 73 allows the door panel 71 to sag slightly on hinges attaching the door panel 71 to the hinge side iamb 72*b*, preferably enough to form an acceptable gap between the top of the door panel 71 and the drip cap along the top of the frame. Thus, inherent play in the hinges may be compensated for by removal of the bottom spacer 73.

Although the bottom spacer 73 is, in the depicted embodiment, attached to the door panel 71, it should be understood that in other embodiments, a bottom spacer could be attached to the latch-side jamb 72*a*, with a portion of the bottom spacer being positioned underneath the bottom edge of the door panel 71 such that, when the door system is being installed, the bottom spacer would still be positioned between the bottom edge of the door panel 71 and the sill 74 to provide the racking as described herein.

Figure 8:
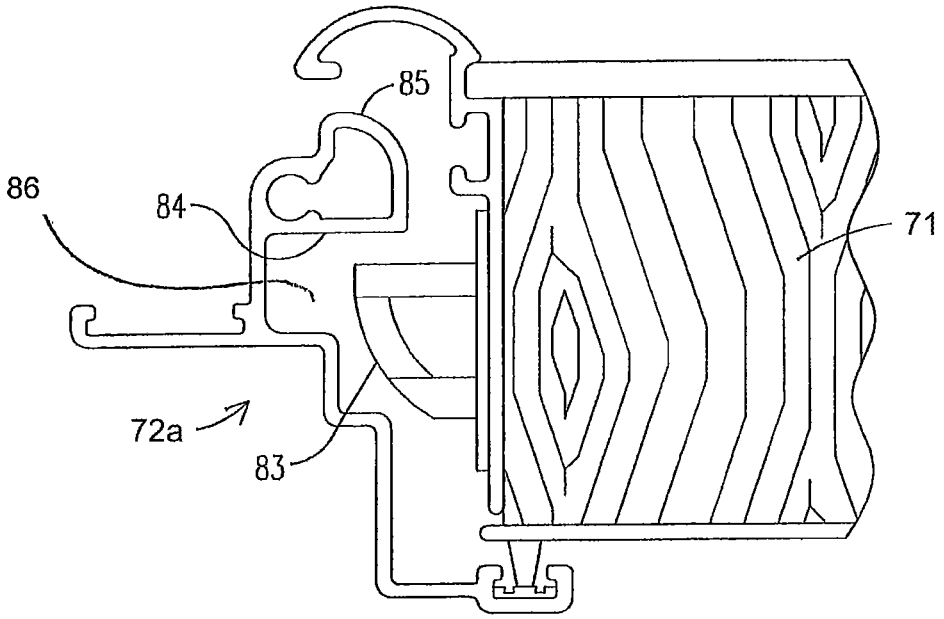
FIG. 8 is a cross-sectional view of one embodiment of a Z-bar or vertical jamb of a door system as described herein taken along line 8-8 in FIG. 7.

Another feature that may be included in some embodiments of the door systems described herein is shown in FIG. 8. Traditional door installation requires that a strike plate be installed along the handle side of the frame and carefully positioned and aligned to receive the latch bolt of the latch assembly when the door is closed. Installing the strike plate properly can be tedious and time consuming. Further, if the door panel should sag or rack over time due, for instance, to settling, the latch bolt can move out of alignment with the strike plate, necessitating repair.

In some embodiments of the door systems described herein, this problem may be addressed by configuring the latch-side jamb of the door frame (sometimes referred to as a "Z-bar") to incorporate the features of a strike plate and strike surface. In some embodiments, the strike plate and strike surface may be provided along only a portion of the length of the latch-side jamb, while in other embodiments the strike plate and strike surface may extend along the entire length of the latch-side jamb.

In the illustrative embodiment of FIG. 8, the latch-side jamb 72*a* is profiled so that it incorporates a curved strike bar 85, an elongated channel 86, and a strike surface 84 that each extends the entire length of the latch-side jamb 72*a*. When the door panel 71 is closed, the latch bolt 83 of its latch assembly first engages the curved strike bar 85 of the latch-side jamb 72*a*, which causes the latch bolt to retract. When the door panel 71 reaches its closed position, the latch bolt 83 moves back to its extended position and into the channel 86 behind the strike surface 84. The strike surface 84 thereby captures the latch bolt 83 and prevents the door panel 71 from opening without operation of the latch assembly. In some embodiments, a deadbolt (if incorporated into a latch mechanism) may also extend into the channel 86 to be captured without the necessity of a separate deadbolt strike plate.

In some embodiments, the channel 86 may be open only at its top and bottom ends, i.e., the latch-side jamb 72*a* may be free of any openings that would allow, e.g., a latch bolt 83, the extend through the latch-side jamb 72*a*. In other words, the door opening jamb (which would be covered by the latch-side jamb 72*a*) cannot be viewed through any opening in the channel 86.

In some embodiments, the latch-side jamb 72*a* may include the strike surface 84 and strike bar 85 that extend over only a portion of the length of the latch-side jamb 72*a*. For example, the strike surface 84 and strike bar 85 may extend over a limited distance of the length of the latch-side jamb 72*a* in which the latch bolt would ever be expected to operate. For example, the strike surface 84 and strike bar 85 may extend over a distance of, e.g., 3 inches or less, 6 inches or less, or even 12 inches or less. In some embodiments, the latch-side jamb may be formed as a continuously extruded part (of, e.g., aluminum, polymer, etc.) and, in such an embodiment, the features that form the strike surface 84, strike bar 85 and channel 86 may inherently extend along the entire length of the latch-side jamb 72*a*. In such an embodiment, filler strips may be provided to occupy the channel 86 of the latch-side jamb 72*a* above and/or below the region in which the latch bolt may be expected to enter the channel 86, such that a latch bolt may be received and retained in only those portions of the channel 86 that are not occupied by the filler strips. In other embodiments, the portion of the latch-side jamb 72*a* that contains the strike surface 84 and strike bar 85 may simply be constructed differently that the remainder of the latch-side jamb 72*a*.

Incorporating strike plate functions into the latch-side jamb itself may offer some advantages such as, e.g., eliminating of the need for a separate strike plate, elimination of the need to provide a hole in the jamb to receive the latch bolt, elimination of the need to position a strike plate on the latch-side jamb, compensation for any future racking or sagging of the door panel within its frame, etc.

Figure 9:
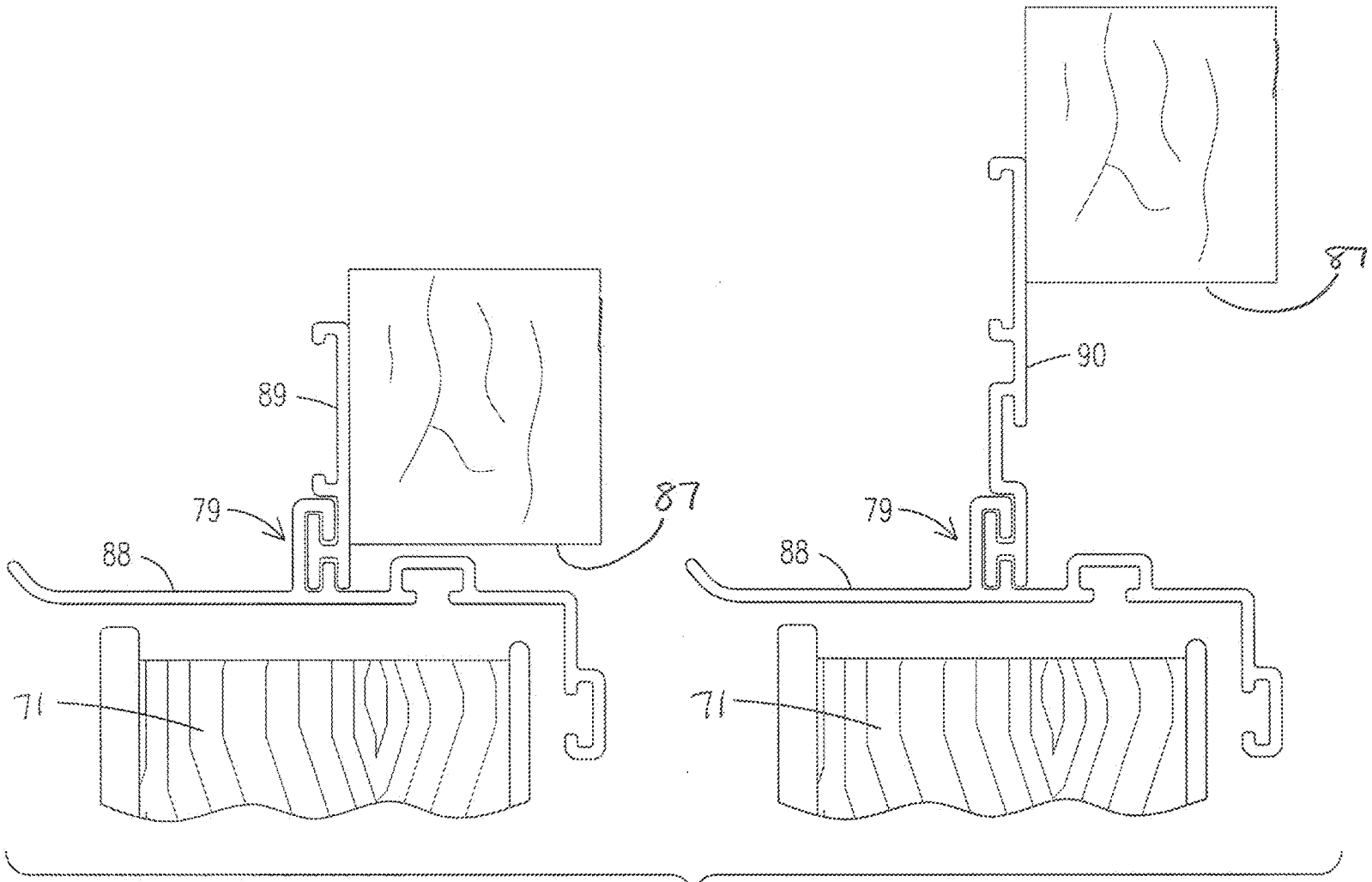
FIG. 9 includes side views of the top portion of embodiments of a door system as described herein illustrating alternate drip cap assemblies to accommodate different gaps above the doer system when installed in an opening.

FIG. 9 illustrates the drip cap assembly that forms a component of some embodiments of the door systems described herein, and that can potentially compensate for varying gaps above the header of the door systems as described herein. As described, the door systems may include a door panel 71 mounted in a frame that includes two spaced vertical jambs, with the door panel being hingedly mounted to one of the jambs. A header 88 that preferably incorporates a drip cap may span and be attached to the tops of both of the jambs above the door panel 71. The gap above the header 88 of an installed door system can vary because, in some embodiments of the door systems described herein, the door and its frame are referenced to the sill of an opening rather than to the header (because, as discussed herein, the bottoms of the jambs 72 rest on the sill when the door system is placed in the opening). Since the height of openings can vary by, e.g., as much as an inch or so, the gap between the top drip cap/header 88 of the door system and the top 87 of the opening can also vary.

Referring to FIG. 9, one embodiment of a drip cap assembly is depicted that may be provided to cover any such gap. In the depicted embodiment, the drip cap assembly rosy include multiple pieces, the drip cap 88 (which also may preferably serve as the header of the door frame) and one or more drip cap mounting flanges 89, 90. In the depicted embodiment, the drip cap 88 is positioned above the top edge of the door panel 71 and below the top of the opening 87 in which the door panel 71 is installed. In some installations in which the gap between the drip cap 88 and the top of the opening 87 is small, the drip cap 88 alone may be sufficient to cover the gap. In other installations, a shorter drip cap flange 89 may be used with the drip cap 88 to span slightly larger gaps between the drip cap 88 and the top of the opening 87 as shown on the left drawing of FIG. 9. In still other installations, a taller drip cap mounting flange 90 with a height greater than the height of the shorter flange 89 may be used with the drip cap 88 to span even taller gaps between the drip cap 88 and the top of the opening as shown on the right in FIG. 9.

The drip cap mounting flanges described herein are preferably configured for attachment above the drip cap/header of the door systems described herein so that the mounting flanges overlap with at least a portion of the drip cap/header to close any gap above the drip cap/header and the top of the opening. In some embodiments, the mounting flanges may, in addition to overlapping the drip cap, be configured to interlock with the drip cap.

In the embodiment depleted in FIG. 9 for example, the mounting flanges 89 and 90 include T-shaped edges that slide into a complementary groove in the drip cap 88 as indicated at 79 to couple the mounting flanges 89 and 90 to the drip cap 88, although it should be understood that many other interlocking and/or overlapping arrangements may be used to provide a suitable cover over any gap that may be present at the top of the door system.

Figure 9A:
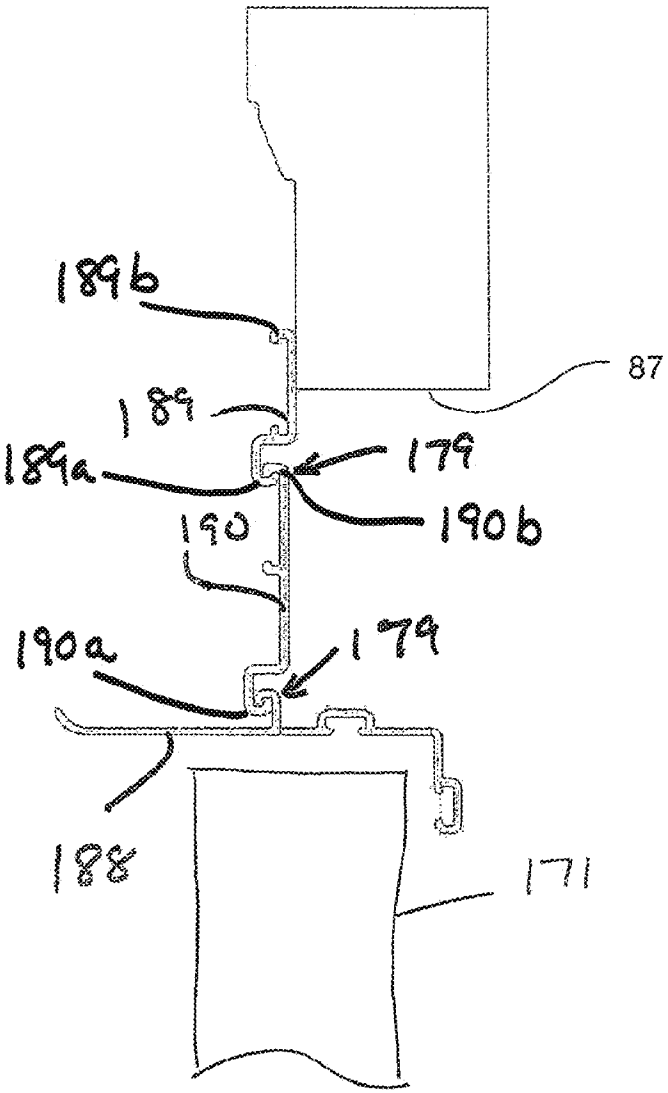
FIG. 9*a* is a side view of another alternative drip cap assembly as described herein.

FIG. 9*a* depicts another alternative drip cap assembly that includes a drip cap 188 and drip cap flanges 189 and 190, with the drip cap 188 being positioned above top edge of the door panel 171 when installed in an opening. Each of the drip cap flanges 189 and 190 may include an edge 189*a* and 190*a* (respectively) configured to interlock with the drip cap 188 as depicted at 179 in FIG. 9*a*. In addition, each of the drip cap flanges 189 and 190 may include an opposite edge 189*b* and 190*b* (respectively) that is also configured to interlock with the other drip cap flange. For example, as seen in FIG. 9*a*, the upper edge 190*b* of the drip cap flange 190 interlocks with the bottom edge 189*a* of drip cap flange 189. As a result, the two flanges 189 and 190 can be used together to span a gap that is larger than either of the drip cap flanges could span alone. Although the two different drip cap flanges of the depicted embodiments have different heights (flange 189 is shorter than flange 190), other embodiments may include two (or more) drip cap flanges that have the same height.

In those embodiments of the door systems described herein that are referenced to and that sit on the sill of an opening during installation, the sweep on the bottom of the door panel may preferably be spaced properly from the sill when installed. If may also be beneficial to protect the sweep fins along the bottom of the sweep during shipment and installation. Protection of the sweep fins as described herein means that the sweep fins are not deflected (or bent) by outside forces acting on the sweep fins (forces such as, e.g., the weight of the door pressing the sweep fins against a shipping container or a door sill during installation).

Figure 10:
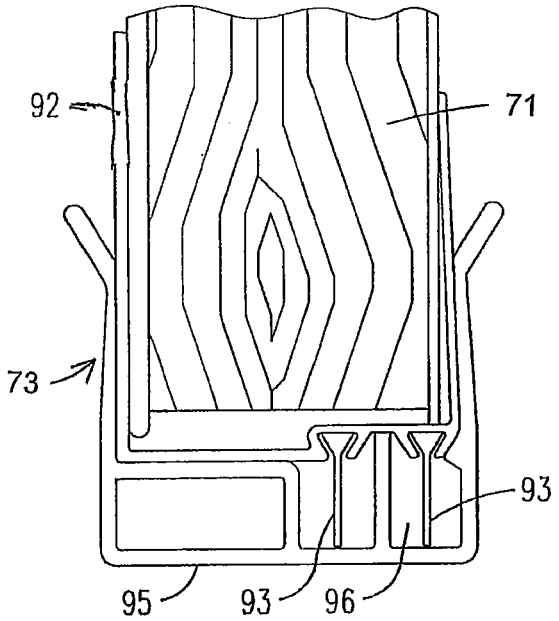
FIG. 10 illustrates one embodiment of a bottom spacer as described herein in a cross-sectional view taken along line 10-10 in FIG. 7.

To accomplish this, the bottom spacer may, in some embodiments, be configured to serve as a sweep fin protector, one embodiment of which is shown in FIG. 10. The depicted sweep 92 includes one or more flexible sweep fins 93 that project downwardly away from the door panel 91. The bottom spacer 73 is removably attached over the sweep 92 such that it is located between the sweep 92 and any surface on which the door system is resting such as, e.g., a sill or a shipping container. The bottom spacer 73 is preferably located beneath the latch side of the door panel such that the bottom of the door panel 91 (and, thus, the sweep 92) is suspended above any surface on which the bottom spacer 94 and the hinged side of the door frame rest. As a result, the flexible sweep fin or fins, which may be made of any suitable flexible material, e.g., rubbers, polymers, wool pile, etc. are preferably not deformed during shipping and/or installation.

In the depicted embodiment, the bottom spacer 73 may be formed with a spacer portion 95 and a sweep fin cover portion 96. Once the door system is installed in an opening, the adjustable sweep 92 can be adjusted downwardly until the spacer portion 95 rests on the sill so that the sweep fins 93 operate properly in conjunction with the sill. The bottom spacer 73 may also be used (as described above in connection with FIG. 7) to compensate for racking of the door panel on its hinges. After the door system is attached in the opening, the door panel can be opened and the bottom spacer 73 removed.

Although the door panels depicted in FIGS. 8-10 show a wood core within an outer cladding, the door panels used in the door systems described herein may be solid, hollow, and/or may be filled with any suitable core material, e.g., wood, foam, etc.

Figure 11:
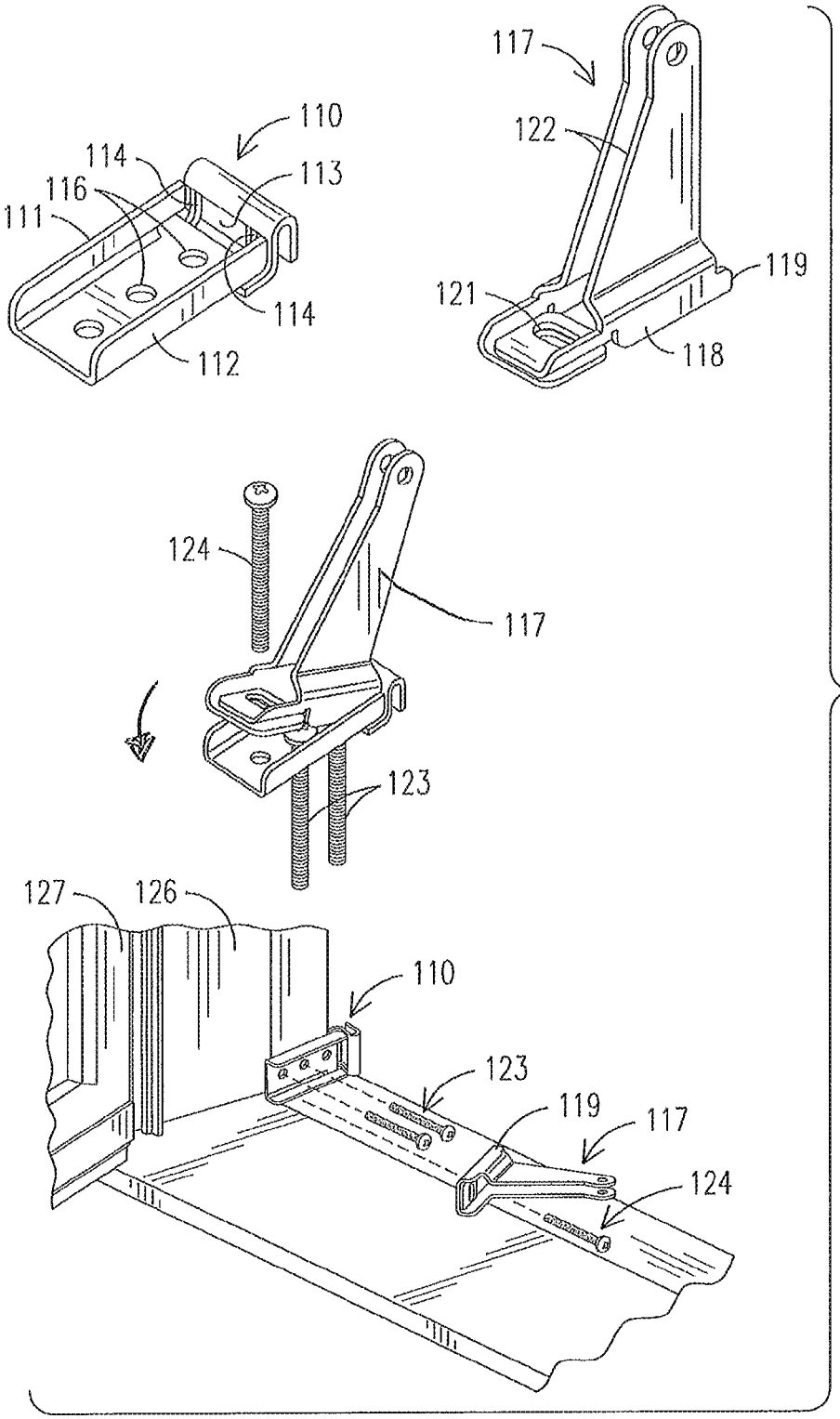
FIG. 11 illustrates an alternate embodiment of a two-piece closer bracket assembly as described herein.

FIG. 11 shows an alternate embodiment of a closer bracket assembly. This embodiment includes a base 110 and a closer bracket 117 that is configured for removable attachment to the base 110. In addition, the closer bracket 117 is also configured to mechanically interlock with the base during installation. In the depicted embodiment, the base 110 is formed with spaced upstanding side walls on either side of a floor through which screw holes 116 are formed. A back wall 113 is disposed at the back end of the base and is formed with one or more spaced apart slots 114 for purposes described below. The closer bracket 117 has a free end having a hole for receiving a pin to attach a closer cylinder to the closer bracket 117.

The other end of the depleted embodiment of the closer bracket 117 is formed with an elongated hole 121 at one end and one or more tabs 119 extending from its other end. Referring to the middle image of FIG. 11, the one or more tabs 119 on the closer bracket 117 are configured to be received in the one or more slots 114 of the base 110, With the tabs 119 mechanically interlocking with the slots 114, the bracket 11 can be pivoted (or otherwise moved) into place between the upstanding side walls of the base, as indicated by the arrow in the middle image.

As shown in the lower image of FIG. 11, for installation, the base 110 is secured to the jamb of an opening in which a door installed. The base 110 is also preferably "self-aligning" such that when the base 110 is positioned to abut the hinge-side jamb of a pre-hung door or the door panel itself in other doors as discussed above in connection with the closer bracket assembly depicted in FIGS. 3-5, the closer bracket assembly will be positioned at the appropriate horizontal location relative to the door.

The base 110 may be secured to the door jamb by any suitable technique. In depleted embodiment, the base 110 is attached to the jamb using two screws 123 driven through two holes of the base 110 and into the jamb as illustrated. The one or more tabs 119 of the bracket 11 are then inserted into the one or more slots 114 of the base and the bracket 117 is pivoted (or otherwise moved) into the base about the tabs. A third screw 124 is then driven through the elongated hole 121, through the aligned forward hole 116 of the base, and into the jamb as illustrated. Thus, as with the prior embodiment, the closer bracket 117 and the base mechanically interlock with each other as a part of the installed closer bracket assembly. In addition, the closer bracket 117 and the base 110 are also preferably "removably attached" as is discussed above in connection with the closer bracket assembly depicted in FIGS. 3-5.

As with the embodiment of the closer bracket assembly depicted in FIGS. 3-5, it should be understood that the actual movement of the closer bracket relative to the base is changeable, e.g., in some designs, the closer bracket may not need to be pivoted to mechanically interlock the base and the closer bracket. In addition, in those embodiments that use one or more tabs and one or more slots to mechanically interlock the base and the closer bracket, the tabs and the slots may be provided on either part, i.e., the tabs are not required to be found on the closer bracket nor are the slots required to be on the base. Any arrangement of the mechanically interlocking structures may be used as long as the structures perform the mechanically interlocking functions required to attach the closer bracket to the base.

Figure 12:
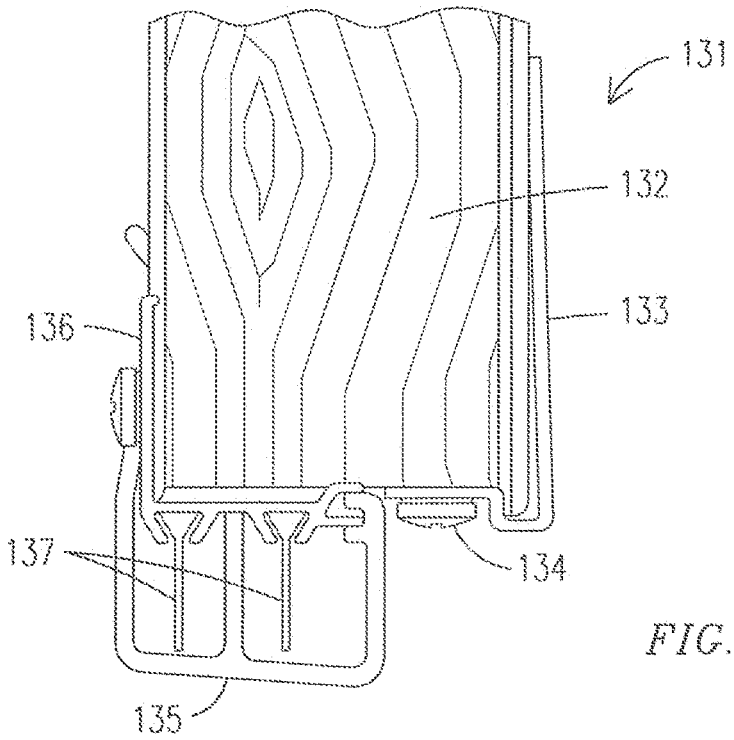
FIG. 12 illustrates an alternate embodiment of the bottom spacer as described herein.

FIG. 12 shows an alternate embodiment of a split sweep and bottom spacer assembly in a view similar to that seen in the prior embodiment depicted in FIG. 10. In this embodiment, the sweep is provided as a two part component comprising a sweep expander 136 bearing fins 137 and a separate hardware finish matched trim plate 133 on the opposite side of the door. A potential advantage of embodiments such as this is that the sweep trim plates with several finishes matching finishes of available door hardware can be included in the product packaging and the correctly matching trim plate attached at the time of installation. As with the prior embodiment, a bottom spacer 135 may be attached over the sweep and remains in place during installation to protect the fins 137 during shipping and create an appropriate gap at the top of the door after installation.

The door panel of some embodiments of the door systems described herein may preferably be held securely within the frame of the door system to help hold the unit in a configuration in which the latch-side jamb on the latching side a the door panel is properly spaced from the edge of the door panel. In addition to protecting the door system during shipping, holding the frame of the door system in such a manner may allow an installer to place the door system in an opening and attach the jambs of the door system to the sides of the opening without requiring the installer to adjust the position of the jambs relative to the door panel to obtain proper spacing between the door panel edge and the jambs of the door system. This can, in some embodiments be accomplished with one or more shipping clips removably attached between the door panel and the frame to secure the door system during shipment and installation. Such clips can be installed at e.g., the openings that ultimately will receive the door latch assembly.

Figure 13A:
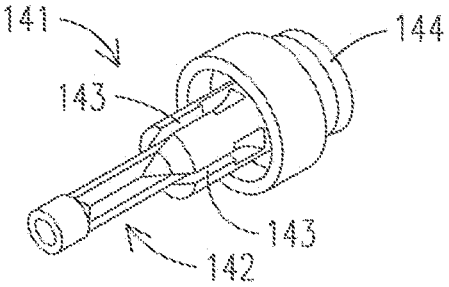
FIGS. 13*a* and 13*b* depict one embodiment of a\fastener as described herein.
Figure 13B:
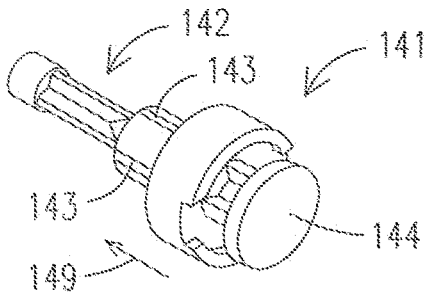

The shipping clips that may be used in connection with some embodiments of the door systems described herein may be attached to the door panel using any suitable fastener or fasteners. One embodiment of a potentially suitable fastener is depicted in FIGS. 13*a* and 13*b* and is in the form of a press-in fastener 141 that can, e.g., replace traditional zip ties and other listeners that may be more difficult to install and/or remove. The press-in fastener 141 has a depressible head 144 and a shaft 142. A set of expansion lobes 143 is arrayed around the shaft 142 as shown. When the depressible head 144 is pressed in as indicated by arrow 149, the expansion lobes 143 are forced to spread radially outwardly (relative to the direction of the arrow 149), and when the head 144 is pulled out in the opposite direction, the lobes retract radially.

Figure 14A:
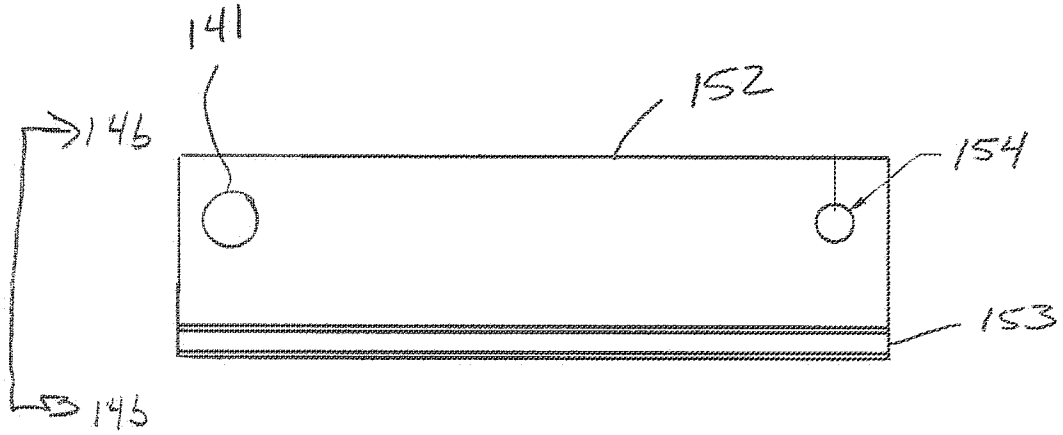
FIGS. 14*a* and 14*b* depict one illustrative embodiment of a shipping clip that may be used in connection with the door systems described herein.
Figure 14B:
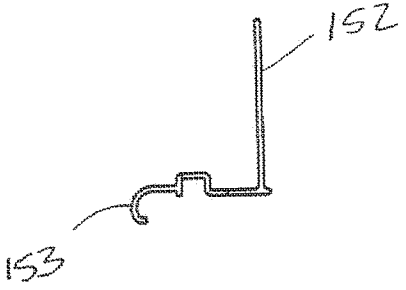

FIGS. 14*a* and 14*b* depict one illustrative embodiment of a shipping clip 152 that can be used with the fasteners 141 to secure a latch-side jamb to a door panel in the some embodiments of the door systems described herein. The shipping clip 152 includes a pair of openings 154 that may preferably be aligned with openings in a door panel used to attach the escutcheon plates of a latch assembly as described herein. One of the openings 154 is obscured by the head of a fastener 141 in the view of FIG. 14*a*. FIG. 14*b* is an end view of the shipping clip 152 as depicted in FIG. 14*a*. The depicted embodiment of the shipping clip 152 includes a retainer portion 153 configured to retain the curved strike bar of the latch-side jamb as described below in connection with FIGS. 15*a*, 15*b* and 15*c*.

Figure 15B:
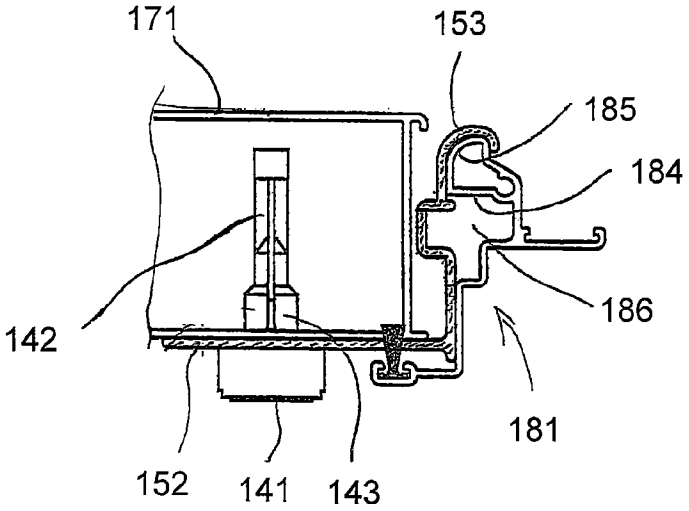
FIGS. 15*b* and 15*c* are cross-sectional views of the shipping clip mounted on a door system as depicted in FIG. 15*a*, the views being taken along cross-sectional line 15*b*-15*b* in FIG. 15*a*.
Figure 15A:
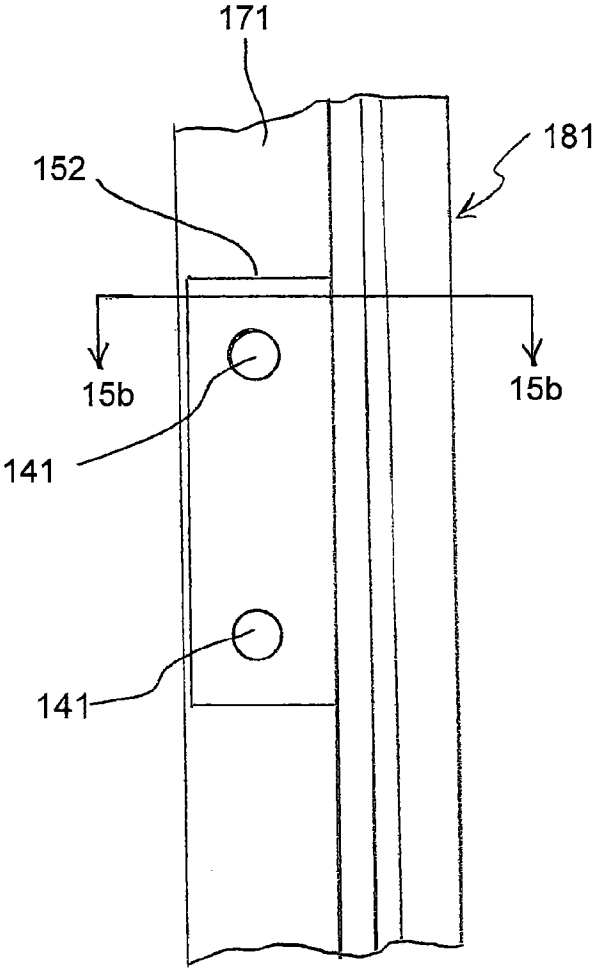
FIG. 15*a* is a side view depicting two fasteners of FIGS. 13*a* and 13*b* and a shipping clip of FIGS. 14*a* and 14*b* on an edge of a door panel as described herein.
Figure 15C:
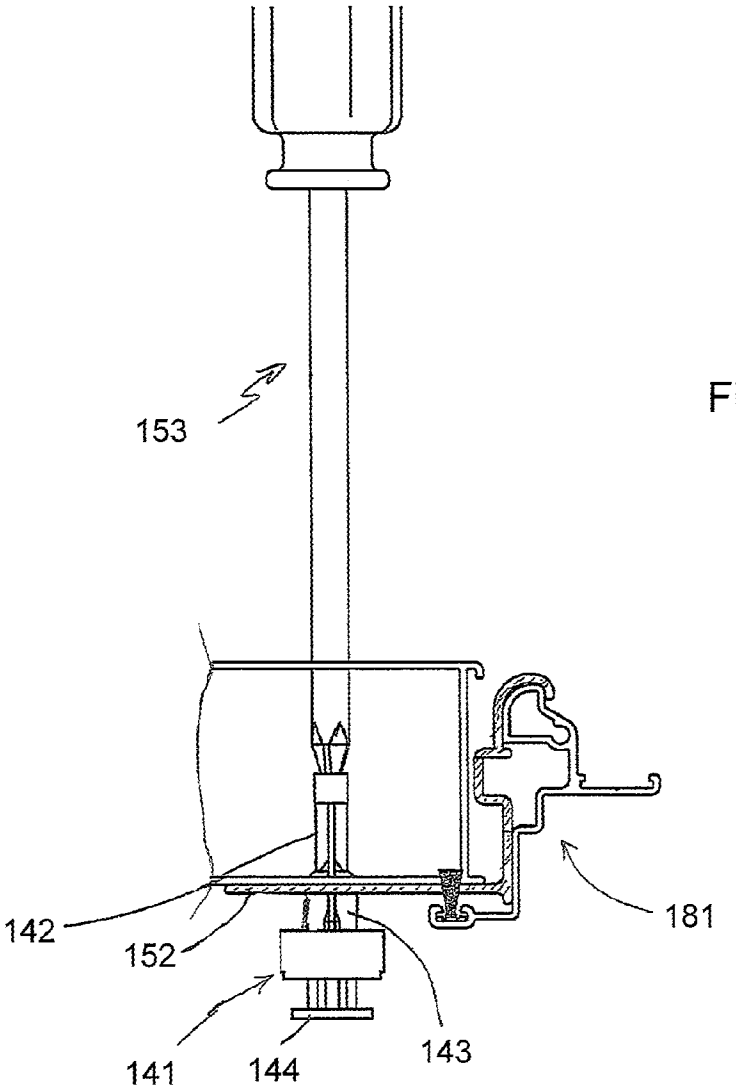

The fasteners 141, as seen in FIGS. 15*a*, 15*b* and 15*c*, can be used to secure a shipping clip 152 to the door panel 171 for holding the door panel 171 and the latch-side jamb 181 together during shipping (and, in some embodiments, also during installation). In some embodiments, the fasteners 141 can be inserted into holes that will receive the latch assembly, with the clip 152 including a hole (not shown) that aligns with a hole in the door panel 171.

To secure the clip 152 to the door panel 171, the fastener 141 is pressed through the hole in the clip 152 and the aligned hole in the door panel 171 and, once in place, its head 144 is depressed. This causes the expansion lobes 143 to expand such that the fastener 141 is retained within the hole. In some embodiments, it may be preferred that the fasteners 141 wedge tightly within the holes to secure the shipping clip 152 firmly in place. One embodiment of this arrangement is seen in, e.g., FIG. 15*b*.

As discussed herein, the clip 152 can also be used to retain the latch-side jamb 181 in place against the edge of the door panel 171. In the depicted embodiment, the clip 152 includes retainer portion 153 configured to retain the curved strike bar 185 of the latch-side jamb 181 as a part of retaining the latch-side jamb 181 in position on the edge of the door panel 171.

It may be preferred that the clip 152 retain the latch-side jamb 181 in a position relative to the edge of the doer panel 171 that is within the range of acceptable spacing between the latch-side jamb 181 and the edge of the door panel 171 for operation of the door after installation. In such an embodiment, the clip 152 is preferably retained on the door panel 171 with the latch-side jamb 181 seemed in place. After the latch-side jamb 181 has been attached to the side of the opening in which the door panel 171 is being installed, the clip 152 cars be removed from both the latch-side jamb 181 and the door panel 171.

As shown in FIG. 15*c*, when it is desired to remove the clip 152 from the door panel 171, this can be done from either side of the door panel. From one side, the depressible head 144 of the fastener 141 can be pulled out to retract the expansion lobes 143 and allow the fastener 141 to be removed from the holes in the clip 152 and the door panel 171. From the other side of the door panel, a screw driver 153 or other appropriate tool (e.g., an awl, pen, pencil, etc.) can be inserted through an opening in the door panel 171 and against the shaft 142 of the fastener 141. The shaft 142 is then pressed towards the head 144 of the fastener 141 using the screw driver, causing the head 144 to pop up for removal of the fastener 141 and, if desired, the clip 152. Thus, the clip 152 is attached securely to the door panel and the latch-side jamb during shipment and installation, but can easily be removed at the appropriate time from either side of the door panel.

Any references and publications cited herein are expressly incorporated herein by reference in their entirety into this disclosure. Illustrative embodiments of the door systems, door hardware components, and methods are discussed and reference has been made to possible variations. These and other variations and modifications in the invention will be apparent to those skilled in the art without departing from the scope of the doer systems, door hardware components, and methods described herein, and it should be understood that this invention is not limited to the illustrative embodiments set forth herein. Accordingly, the invention is to be limited only by the claims provided below end equivalents thereof.

What is claimed is:

1. A method of installing a door system including a door panel and a frame in an opening of a building having a sill, wherein the frame comprises a latch side vertical iamb and a hinge side vertical jamb and a header attached to and spanning a top of the latch side vertical jamb and a top of the hinge side vertical jamb, and wherein the door panel comprises a first side edge, a second side edge, a top edge, and a bottom edge, the door panel being hingedly mounted along the first side edge to the hinge side vertical jamb, wherein the method comprises:

positioning the door system within the opening such that a bottom of the latch side vertical jamb and a bottom of the hinge side vertical jamb rest on the sill, and wherein a gap is formed between the header and a top of the opening when the bottom of the latch side vertical jamb and the bottom of the hinge side vertical jamb are resting on the sill;

racking the door system in the opening such that the door system is out of square with respect to the opening when the bottom of the latch side vertical jamb and the bottom of the hinge side vertical jamb are resting on the sill, wherein the racking is caused by a bottom spacer attached to the door system and positioned between the bottom edge of the door panel and the sill, wherein the bottom spacer is located closer to the second side edge of the door panel and the latch side vertical jamb than to the first side edge of the door panel and the hinge side vertical jamb such that the bottom edge of door panel at the second side edge is farther from the sill than the bottom edge of the panel at first side edge;

attaching the hinge side vertical jamb to the opening while the bottom spacer is located between the bottom edge of the door panel and the sill; and covering the gap after attaching the hinge side vertical jamb to the opening.

2. The method of claim 1, further comprising attaching a base of a closer bracket assembly to the opening, removably attaching a closer bracket to the base after attaching the base to the opening, attaching a first end of a closer cylinder to the closer bracket after attaching the closer bracket to the base, and attaching a second end of the closer cylinder to the door panel.

3. The method of claim 2, wherein attaching the closer bracket to the base comprises mechanically interlocking the base and the closer bracket.

4. The method of claim 1, wherein covering the gap comprises attaching a mounting flange to the header.

5. The method of claim 4, wherein attaching the mounting flange to the header comprises overlapping a portion of the header with a bottom edge of the mounting flange.

6. The method of claim 1, wherein the door system comprises a first mounting flange and a second mounting flange, wherein the first mounting flange has a first height and the second mounting flange has a second height, wherein the first height and the second height are different, and wherein the method further comprises selecting the first mounting flange or the second mounting flange based on a size of the gap to be covered, wherein covering the gap comprises covering the gap with the selected first mounting flange or second mounting flange.

7. The method of claim 1, wherein the door system comprises a first mounting flange and a second mounting flange, and wherein covering the gap comprises attaching the first mounting flange to the header and attaching the second mounting flange to the first mounting flange.

8. The method of claim 7, wherein attaching the mounting flange to the header comprises interlocking a bottom edge of the first mounting flange with the header, and wherein the method further comprises interlocking a top edge of the first mounting flange with a bottom edge of the second mounting flange.

9. The method of claim 1, wherein the door system comprises a sweep having one or more sweep fins disposed along the bottom edge of the door panel, and wherein the bottom spacer covers at least a portion of the one or more sweep fins when the bottom spacer is positioned between the bottom edge of the door panel and the sill.

10. The method of claim 1, wherein the latch side vertical jamb comprises a channel, and wherein the channel receives and captures a latch bolt of the door panel when the door panel is closed.

11. The method of claim 10, wherein the latch side vertical jamb is shaped to define a strike bar, and wherein the strike bar engages and retracts a latch bolt as the door panel closes.

12. The method of claim 1, wherein the method further comprises installing a latch assembly on the door panel, the latch assembly comprising a latch mechanism, a first escutcheon plate, a second escutcheon plate, a first handle, and a second handle, wherein installing the latch assembly comprises:

attaching the first escutcheon plate to a first side of the door panel and the second escutcheon plate to a second side of the door panel;

inserting the first handle into an opening in the first escutcheon plate when the first handle is in an insertion orientation relative to the first escutcheon plate, wherein the first handle cannot be detached from the first escutcheon plate when the first handle is not in the insertion orientation relative to the first escutcheon plate and the first escutcheon plate is attached to the door panel.

13. The method of claim 12, wherein the first handle has a hub comprising a key and the first escutcheon plate has a handle opening comprising a complementary keyway, the keyway receiving the key when the first handle is in the insertion orientation relative to the first escutcheon plate.

14. The method of claim 12, wherein the method further comprises inserting the second handle into an opening in the second escutcheon plate when the second handle is in an insertion orientation relative to the second escutcheon plate, wherein the second handle cannot be detached from the second escutcheon plate when the second handle is not in the insertion orientation relative to the second escutcheon plate and the second escutcheon plate is attached to the door panel.

15. The method of claim 14, wherein the second handle has a hub comprising a key and the second escutcheon plate has a handle opening comprising a complementary keyway, the keyway receiving the key when the second handle is in the insertion orientation relative to the second escutcheon plate.

16. A method of installing a door system including a door panel and a frame in an opening of a building having a sill, wherein the frame comprises a latch side vertical jamb, a hinge side vertical jamb and a header attached to and spanning a top of the latch side vertical iamb and a top of the hinge side vertical jamb, and wherein the door panel comprises a first side edge, a second side edge, a top edge, and a bottom edge, the door panel being hingedly mounted along the first side edge to the hinge side vertical jamb, the method comprising:

positioning the door system within the opening;

racking the door system in the opening such that the door system is out of square with respect to the opening by resting the bottom of the latch side vertical jamb and the hinge side vertical on the sill, wherein the racking is caused by a bottom spacer attached to the door system and positioned between the bottom edge of the door panel and the sill, wherein the bottom spacer is located closer to the second side edge and the latch side vertical jamb than to the first side edge and the hinge side vertical jamb and wherein the bottom edge of the door panel is located further away from the sill at the second side edge than at the first side edge;

attaching the hinge side vertical jamb to the opening while the bottom spacer is located between the bottom edge of the door panel and the sill; and removing the bottom spacer after attaching the hinge side vertical jamb to the opening.

17. The method of claim 16, wherein a gap is defined between the header and a top of the opening when the bottom of the latch side vertical jamb and the bottom of the hinge side vertical jamb are resting on the sill, and wherein the method further comprises covering the gap.

18. The method of claim 17, wherein the covering the gap comprises attaching a mounting flange to the header.

19. The method of claim 18, wherein attaching the mounting flange to the header comprises interlocking a bottom edge of the mounting flange with the header.

20. The method of claim 17, wherein the door system comprises a first mounting flange and a second mounting flange, and wherein covering the gap comprises covering the gap with the first mounting flange and the second mounting flange.

21. The method of claim 20, wherein covering the gap comprises interlocking a bottom edge of the first mounting flange with the header, and wherein the method further comprises interlocking a top edge of the first mounting flange with a bottom edge of the second mounting flange.

22. The method of claim 16, wherein the door system comprises a sweep having one or more sweep fins disposed along the bottom edge of the door panel, and wherein the bottom spacer covers at least a portion of the one or more sweep fins when the bottom spacer is positioned between the bottom edge of the door panel and the sill.

23. The method of claim 16, wherein the latch side vertical jamb comprises a channel, and wherein the channel receives and captures a latch bolt of the door panel when the door panel is closed.

24. The method of claim 16, further comprising attaching a base of a closer bracket assembly to the opening, removably attaching a closer bracket to the base after attaching the base to the opening, attaching a first end of a closer cylinder to the closer bracket after attaching the closer bracket to the base, and attaching a second end of the closer cylinder to the door panel.

25. The method of claim 24, wherein removably attaching the closer bracket to the base comprises mechanically interlocking the base and the closer bracket.

26. The method of claim 16, wherein the method further comprises installing a latch assembly on the door panel, the latch assembly comprising a latch mechanism, a first escutcheon plate, a second escutcheon plate, a first handle, and a second handle, wherein installing the latch assembly comprises:

attaching the first escutcheon plate to a first side of the door panel and the second escutcheon plate to a second side of the door panel;

inserting the first handle into an opening in the first escutcheon plate when the first handle is in an insertion orientation relative to the first escutcheon plate, wherein the first handle cannot be detached from the first escutcheon plate when the first handle is not in the insertion orientation relative to the first escutcheon plate and the first escutcheon plate is attached to the door panel.

27. The method of claim 26, wherein the first handle has a hub comprising a key and the first escutcheon plate has a handle opening comprising a complementary keyway, the keyway receiving the key when the first handle is in the insertion orientation relative to the first escutcheon plate.

28. The method of claim 26, wherein the method further comprises inserting the second handle into an opening in the second escutcheon plate when the second handle is in an insertion orientation relative to the second escutcheon plate, wherein the second handle cannot be detached from the second escutcheon plate when the second handle is not in the insertion orientation relative to the second escutcheon plate and the second escutcheon plate is attached to the door panel.

29. The method of claim 28, wherein the second handle has a hub comprising a key and the second escutcheon plate has a handle opening comprising a complementary keyway, the keyway receiving the key when the second handle is in the insertion orientation relative to the second escutcheon plate.

30. The method of claim 4, wherein attaching the mounting flange to the header comprises interlocking a bottom edge of the mounting flange with the header.

31. The method of claim 1, wherein the bottom spacer is attached to the door panel.

32. The method of claim 31, wherein the method further comprises detaching the bottom spacer from the door panel after attaching the hinge side vertical jamb to the opening.

33. The method of claim 16, wherein the bottom spacer is attached to the door panel.

34. The method of claim 33, wherein the method further comprises detaching the bottom spacer from the door panel after attaching the hinge side vertical jamb to the opening.

* * * * *